US008957295B2

(12) United States Patent
Tsuchiya et al.

(10) Patent No.: US 8,957,295 B2
(45) Date of Patent: Feb. 17, 2015

(54) SOUND GENERATION APPARATUS

(71) Applicant: Yamaha Corporation, Hamamatsu-Shi, Shizuoka-Ken (JP)

(72) Inventors: Hiroyuki Tsuchiya, Hamamatsu (JP); Eiichi Takeishi, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 14/072,575

(22) Filed: Nov. 5, 2013

(65) Prior Publication Data

US 2014/0123835 A1 May 8, 2014

(30) Foreign Application Priority Data

Nov. 5, 2012 (JP) ..... 2012-244002

(51) Int. Cl.
*G10H 7/02* (2006.01)

(52) U.S. Cl.
USPC ..... 84/604; 84/606

(58) Field of Classification Search
USPC ..... 84/604–607
See application file for complete search history.

(56) References Cited

U.S. PATENT DOCUMENTS 3,731,284 A * 5/1973 Thies ..... 708/200
4,373,416 A * 2/1983 Endo et al. ..... 84/604
4,467,690 A * 8/1984 Nishimoto ..... 84/635
4,872,385 A * 10/1989 Oguri et al. ..... 84/635
5,253,255 A * 10/1993 Carbine ..... 714/734
5,342,990 A * 8/1994 Rossum ..... 84/603
5,355,504 A * 10/1994 Nedwek ..... 712/13
5,461,190 A * 10/1995 Terada ..... 84/609
5,638,516 A * 6/1997 Duzett et al. ..... 709/239
5,698,802 A * 12/1997 Kamiya ..... 84/604
5,698,803 A * 12/1997 Rossum ..... 84/607
5,710,386 A * 1/1998 Abe ..... 84/602
5,804,749 A * 9/1998 Shirakawa et al. ..... 84/601
5,822,768 A * 10/1998 Shakkarwar ..... 711/149
5,850,050 A * 12/1998 Isozaki et al. ..... 84/622
5,892,170 A * 4/1999 Ichiki et al. ..... 84/605
5,895,877 A * 4/1999 Tamura ..... 84/625

(Continued)

FOREIGN PATENT DOCUMENTS

JP 2011-202866 A 7/1999

OTHER PUBLICATIONS

Spiflash. (Jul. 8, 2010). "64M-bit, Serial Flash Memory with Dual and Quad SPI," Windbond Electronics Corp, W25Q64BV, located at http://www.winbond.com/hq/en u/ProductAndSales/ProductLines/FlashMemory/SerialFlash/W25Q64BV.htm, 62 pages.

*Primary Examiner* — David S. Warren
(74) *Attorney, Agent, or Firm* — Morrison & Foerster LLP

(57) ABSTRACT

A serial memory stores a plurality of waveform samples. A tone generating unit has a plurality of channels operating in time-divisional manner to generate therethrough sound signals based on waveform samples read from the serial memory, each channel issuing a sample request for a waveform sample with specifying a read address of the waveform sample. Upon power on or reset of the tone generating unit, an access unit sets the serial memory to enable n-bit input/output operation. In response to the sample request, the access unit uses an n-bit input/output instruction to read the waveform sample by n bits per clock from a lead address that is the read address specified by the sample request, and supplies the waveform sample read from the serial memory to the tone generating unit.

9 Claims, 4 Drawing Sheets

(56) References Cited

U.S. PATENT DOCUMENTS

| | | | | | |
|---|---|---|---|---|---|
| 5,913,258 | A * | 6/1999 | Tamura | 84/604 |
| 5,925,841 | A * | 7/1999 | Rossum | 84/603 |
| 5,955,691 | A * | 9/1999 | Suzuki et al. | 84/604 |
| 6,055,619 | A * | 4/2000 | North et al. | 712/36 |
| 6,137,043 | A * | 10/2000 | Rossum | 84/603 |
| 6,137,046 | A * | 10/2000 | Kamiya | 84/604 |
| 6,140,566 | A * | 10/2000 | Tamura | 84/609 |
| 6,184,455 | B1 * | 2/2001 | Tamura | 84/625 |
| 6,365,816 | B1 * | 4/2002 | Rossum | 84/603 |
| 6,441,290 | B2 * | 8/2002 | Fujita et al. | 84/603 |
| 6,622,207 | B1 * | 9/2003 | Rossum | 711/118 |
| 6,858,790 | B2 * | 2/2005 | Rossum | 84/603 |
| 7,329,811 | B2 * | 2/2008 | Hirano | 84/604 |
| 7,381,879 | B2 * | 6/2008 | Tamura | 84/604 |
| 7,420,115 | B2 * | 9/2008 | Kawamoto et al. | 84/615 |
| 7,723,601 | B2 * | 5/2010 | Kamath et al. | 84/604 |
| 8,450,589 | B2 * | 5/2013 | Nakanishi | 84/604 |
| 8,706,506 | B2 * | 4/2014 | Okazaki | 704/500 |
| 2005/0211070 | A1 * | 9/2005 | Tamura | 84/603 |
| 2006/0137515 | A1 * | 6/2006 | Kawamoto et al. | 84/602 |
| 2007/0119289 | A1 * | 5/2007 | Hirano | 84/603 |
| 2008/0167882 | A1 * | 7/2008 | Okazaki | 704/503 |
| 2008/0229912 | A1 * | 9/2008 | Kamath et al. | 84/603 |
| 2009/0019992 | A1 * | 1/2009 | Mizuhiki et al. | 84/604 |
| 2013/0233153 | A1 * | 9/2013 | Nagasaka | 84/604 |
| 2014/0007754 | A1 * | 1/2014 | Nagasaka | 84/604 |
| 2014/0123835 | A1 * | 5/2014 | Tsuchiya et al. | 84/604 |

* cited by examiner

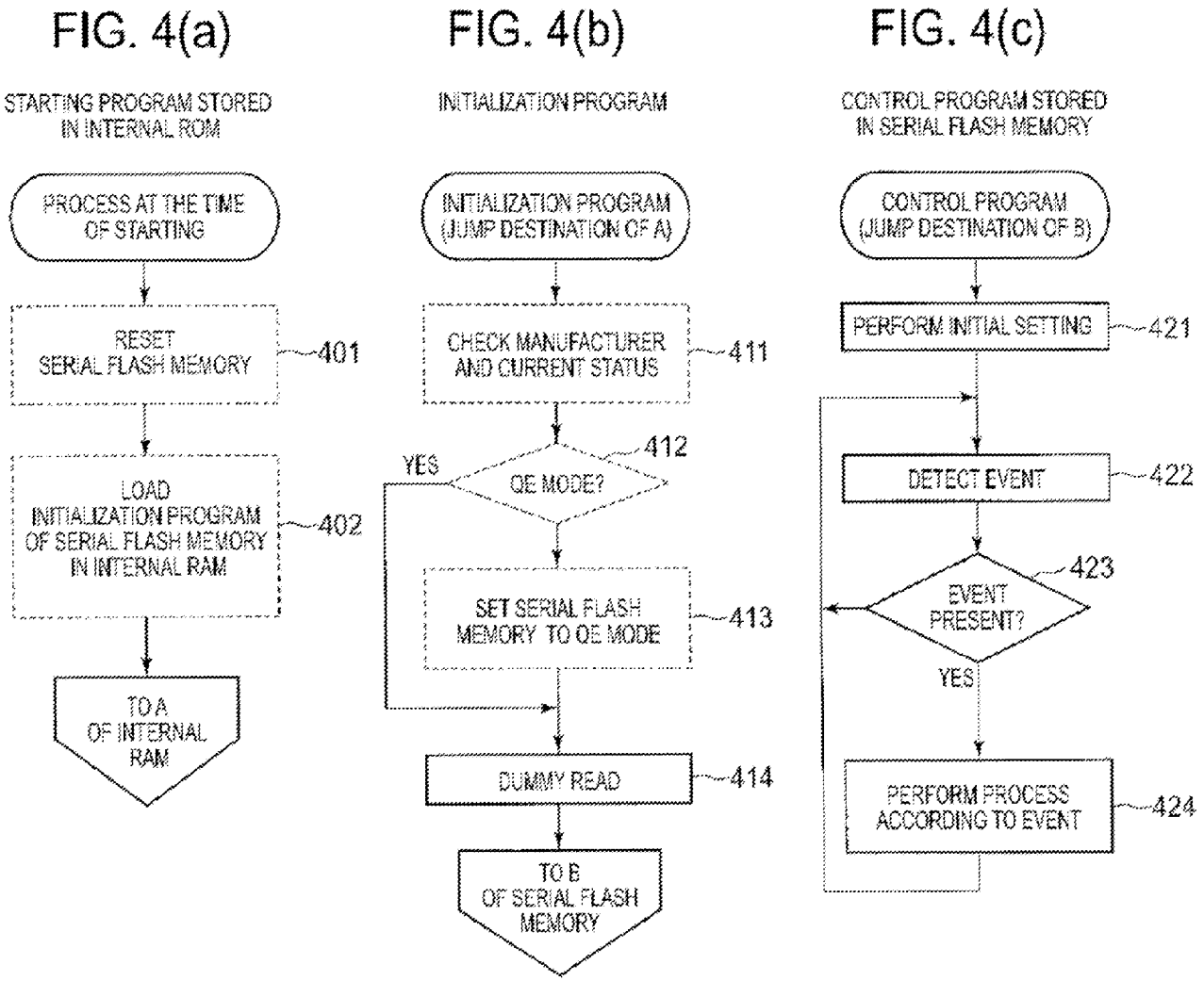
FIG. 4(a)
STARTING PROGRAM STORED IN INTERNAL ROM
PROCESS AT THE TIME OF STARTING
401
RESET SERIAL FLASH MEMORY
402
LOAD INITIALIZATION PROGRAM OF SERIAL FLASH MEMORY IN INTERNAL RAM
TO A OF INTERNAL RAM
FIG. 4(b)
INITIALIZATION PROGRAM
INITIALIZATION PROGRAM (JUMP DESTINATION OF A)
411
CHECK MANUFACTURER AND CURRENT STATUS
412
QE MODE?
YES
413
SET SERIAL FLASH MEMORY TO QE MODE
414
DUMMY READ
TO B OF SERIAL FLASH MEMORY
FIG. 4(c)
CONTROL PROGRAM STORED IN SERIAL FLASH MEMORY
CONTROL PROGRAM (JUMP DESTINATION OF B)
421
PERFORM INITIAL SETTING
422
DETECT EVENT
423
EVENT PRESENT?
YES
424
PERFORM PROCESS ACCORDING TO EVENT

SOUND GENERATION APPARATUS

BACKGROUND OF THE INVENTION

1. Technical Field of the Invention

The present invention relates to a sound generation apparatus using a serial flash memory having a small number of terminals.

2. Description of the Related Art

A so-called waveform memory tone generator for generating a musical sound signal is well known from the past. The waveform memory tone generator reads waveform data from a waveform memory according to a musical sound generation instruction to generate a musical sound signal. Various kinds of memory devices, such as a read only memory (ROM), a flash memory, and a random access memory (RAM), are used as the waveform memory for storing waveform data.

Patent Literature 1 discloses a one-chip tone generator LSI including a CPU and a tone generating unit provided therein. To the tone generator LSI is connected a read only memory for storing a program executed by the CPU and waveform sample data used for the tone generating unit to generate a musical sound. The tone generating unit generates musical sounds by a plurality of channels (ch) through time division processing. In a time slot of each channel, therefore, the tone generating unit performs an access to the read only memory through a parallel bit address having a plurality of bits and reads waveform samples, which are parallel bit data having a plurality of bits. At the same time, the CPU executes various control operations. Consequently, the CPU performs an access to the read only memory through a parallel bit address having a plurality of bits and reads program instructions of a control program, which are also parallel bit data having a plurality of bits.

On the other hand, a so-called serial flash memory (hereinafter, occasionally referred to as a 'serial flash') is well known as a semiconductor memory device. The serial flash memory can reduce a pattern area of a circuit board and can reduce the number of wires (for example, see Non-Patent Literature 1 below). The serial flash is a memory device wherein the number of terminals (pins) is small and each pin has a plurality of functions. For example, the serial flash may include 8 pins, such as a power supply pin VCC, a ground pin GND, a pin for a chip select signal CS, a pin for a clock signal CLK, and data input and output pins IO1 to IO4. It is possible for the serial flash to read data in several different manners according to a set mode or a designated instruction. In addition, the serial flash has a small number of pins and thus requires a reduced number of wires.

Consequently, it is possible to reduce the area of the serial flash mounted on the board.

[Patent Literature 1] Japanese Patent No. 3152198

[Non-Patent Literature 1] http://www.winbond.com/hq/enu/ProductAndSales/ProductLines/FlashMemory/SerialFlash/W25Q64BV.htm In the conventional waveform memory tone generator as described above, a memory having a large number of pins constituting address terminals and data input and output terminals is used as the waveform memory for storing waveform sample data. As a result, the chip sizes of the tone generator LSI and the waveform memory are increased and thus the number of wires therebetween is increased. Consequently, the areas of the tone generator LSI and the waveform memory mounted on a circuit board are increased with the result that it is necessary to provide a large-sized printed circuit board. In order to reduce the chip sizes of the tone generator LSI and the waveform memory and to configure the circuit board to have a compact structure, it may be considered to store waveform data in the serial flash having a small number of pins as described above. However, the serial flash serially reads data with the result that read speed is slow. For this reason, the serial flash generally reads waveform sample data with the result that the available number of tone generating channels is small.

Particularly, in an electronic musical instrument of a type that stores waveform sample data and a program executed by a CPU in the read only memory as disclosed in Patent Literature 1 described above, the program is read by the CPU simultaneously when the waveform sample data are read with the result that read speed of the waveform sample data is further reduced.

SUMMARY OF THE INVENTION

It is an object of the present invention to provide a sound generation apparatus wherein a serial flash is used as a memory for storing both waveform sample data used by a tone generating unit and a program used by a CPU such that a circuit board is configured to have a compact structure and, in addition, it is possible to secure the available number of musical sound generation channels almost equal to that of musical sound generation channels of the conventional sound generation apparatus even using the serial flash.

In order to accomplish the above object, according to the invention, a sound generation apparatus comprises: a serial memory that stores information in units of m bits per address, the stored information including waveform data representing a plurality of waveform samples, the serial memory being capable of performing different input/output operations including n-bit input/output operation for serially inputting and outputting n bits per clock using n pins (m and n being integers equal to or greater than 2 and m>n); an access unit that performs a read access to the serial memory for reading therefrom the waveform data; and a tone generating unit that has a plurality of channels operating in time-divisional manner to generate therethrough sound signals based on waveform samples read from the serial memory, each channel issuing a sample request for a waveform sample to the access unit with specifying a read address of the waveform sample, wherein upon power on or reset of the sound generation apparatus, the access unit sets the serial memory to enable the n-bit input/output operation, and in response to the sample request from each channel of the tone generating unit, the access unit uses an n-bit input/output instruction to read the waveform sample by n bits per clock from a lead address that is the read address specified by the sample request, and supplies the waveform sample read from the serial memory to the tone generating unit.

In another aspect of the invention, a sound generation apparatus comprises: a serial memory that stores information in units of m bits per address, the stored information including waveform data representing a plurality of waveform samples and a control program composed of a plurality of program codes, the serial memory being capable of performing different input/output operations including n-bit input/output operation for serially inputting and outputting n bits per clock using n pins (m and n being integers equal to or greater than 2 and m>n); an access unit that performs a read access to the serial memory for reading therefrom the waveform data and the control program; a tone generating unit that has a plurality of channels operating in time-divisional manner to generate therethrough sound signals based on waveform samples read from the serial memory, each channel issuing a sample request for a waveform sample to the access unit with specifying a read address of the waveform sample; and a processor that issues a code request for a program code to the access unit with specifying a read address of the waveform sample and that fetches the program code supplied from the access unit in response to the code request to thereby execute the control program and thus to control the tone generating unit, wherein upon power on or reset of the sound generation apparatus, the access unit sets the serial memory to enable the n-bit input/output operation. In response to the sample request from each channel of the tone generating unit, the access unit uses an n-bit input/output instruction to read the waveform sample by n bits per clock from a lead address that is the read address specified by the sample request, and supplies the waveform sample read from the serial memory to the tone generating unit, and in response to the code request from the processor, the access unit uses an n-bit input/output instruction to read the program code by n bits per clock from a lead address that is the read address specified by the code request from the processor and supplies the program code read from the serial memory to the processor.

In a preferred form of the invention, according to one read access performed by the access unit in response to the sample request or code request, the serial memory outputs a sequence of units each composed of m bits, from the lead address that is the read address specified by the sample request or code request and from subsequent addresses immediately following the lead address, and the access unit performs one read access to the serial memory using the n-bit input/output instruction in response to the sample request issued from each channel of the tone generating unit so as to read a plurality of waveform samples in the form of a sequence of units of m bits from the lead address and subsequent addresses, and supplies the read waveform samples to the tone generating unit.

In a preferred form of the invention, the serial memory can be set to a continuous read mode, in which the serial memory receives an input/output instruction and a read address from the access unit in response to a first read access performed by the access unit and outputs information according to the received input/output instruction from the lead address that is the received read address, and in which the serial memory receives another read address without the input/output instruction from the access unit in response to a second read access performed by the access unit and outputs information according to the same input/output instruction as that received in the first read access from the lead address that is the read address received in the second read access, and wherein the access unit performs an initial read access upon power on or reset of the sound generation apparatus for setting the serial memory to the continuous read mode, then the access unit performs a subsequent read access including a read address and excluding an input/output instruction in response to a sample request issued from each channel of the tone generating unit for reading a waveform sample from the read address included in the subsequent read access and supplies the read waveform sample to the tone generating unit, and also the access unit performs a subsequent read access including a reading address and excluding an input/output instruction in response to a code request issued from the processor for reading a program code from the read address included in the subsequent read access and supplies the read program code to the processor.

In a preferred form of the invention, a time slot allocated in time-divisional manner to each channel of the tone generating unit has a time length sufficient such that in response to a sample request issued from a channel of the tone generating unit subsequently from a code request issued from the processor, the access unit completes reading of the waveform sample within the time slot allocated to the channel after reading of the program code is completed in response to the code request issued from the processor in the same time slot.

According to the present invention, it is possible to provide a sound generation apparatus that is capable of adopting a serial memory as a medium for storing waveform data and is capable of operating while reading the waveform data from the serial memory in time divisional manner. Consequently, sizes of the serial memory and a tone generating unit are decreased. Furthermore, the number of wires between the serial memory and the tone generating unit is decreased. As a result, the areas of a sound generation circuit constituted by the serial memory and the tone generating unit mounted on a printed circuit board are greatly reduced. In addition, a waveform sample is read through the use of an n-bit input/output instruction (hereafter, referred to as "n IO read instruction") using n pins in each channel. Consequently, it is possible to increase the number of simultaneous tones to be generated.

Furthermore, it is possible to provide a sound generation apparatus that is capable of adopting a serial memory as a medium for storing waveform data and an operating program (program codes of a control program) and is capable of operating while reading the waveform data and the operating program from the serial memory in time divisional manner. Consequently, sizes of the serial memory, a tone generating unit, and a processor are decreased. Furthermore, the number of wires between the serial memory and the tone generating unit or the processor is decreased. As a result, the areas of a sound generation circuit constituted by the serial memory, the tone generating unit, and the processor mounted on a printed circuit board are greatly reduced. Waveform data for tone generation by each channel of the tone generating unit and the program codes of the operating program executed by a CPU are read from one serial flash memory using an n IO read instruction. Consequently, it is possible to increase the number of simultaneous pronunciations of the tone generating unit and to achieve higher-speed operation of the CPU.

In addition, the continuous read mode is set at the time of power on or reset. Consequently, it is possible to read a waveform sample of each channel of a tone generator through an access based on an address, from which an operation instruction is omitted, and to reduce a memory access time of each channel, thereby increasing the number of simultaneous pronunciations of the tone generating unit. Even in a case in which waveform data and an operating program are stored in one memory, the continuous read mode is set at the time of power on or reset and thus it is possible to read a waveform sample of the sound source for sound generation and a program code executed by a processor through an access based on an address, from which an input/output instruction is omitted, and to increase the number of simultaneous pronunciations of the tone generating unit and to achieve higher-speed operation of the CPU. Furthermore, a time slot of the access unit in each channel has a time length sufficient such that, even if a program code is read according to a read request from the processor, the reading of the waveform sample according to the read request from the tone generating unit can be ended after the reading of the program code is ended. Consequently, it is possible to prevent failure in sound generation of the tone generating unit in each channel even when a memory access from the processor is performed.

BRIEF DESCRIPTION OF THE DRAWINGS

FIGS. 4(*a*), 4(*b*) and 4(*c*) are flowcharts of programs executed by the CPU.

DETAILED DESCRIPTION OF THE INVENTION

Hereinafter, an embodiment of the present invention will be described with reference to the accompanying drawings.

Figure 1:
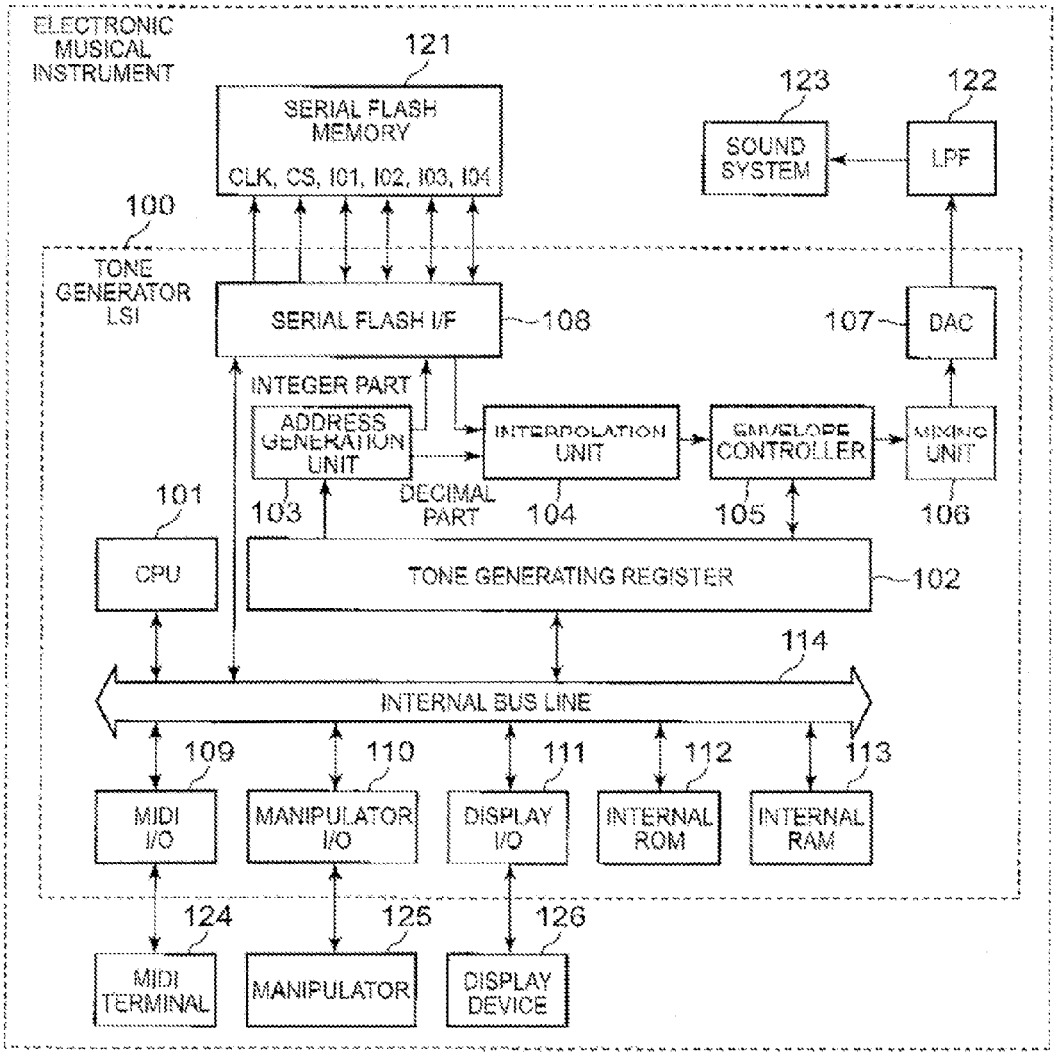
FIG. 1 is a block diagram showing a hard ware configuration of an electronic musical instrument according to an embodiment to which the present invention is applied.

FIG. 1 is a block diagram showing a hard ware configuration of an electronic musical instrument according to an embodiment to which a sound generation apparatus according to the present invention is applied. The electronic musical instrument includes a large scale integrated circuit (LSI) 100 of a tone generator and a serial flash memory 121 mounted on a board, the tone generator LSI 100 and the serial flash memory 121 each being a semiconductor chip. The electronic musical instrument further includes, as peripheral circuits, a low pass filter (LPF) 122, a sound system 123 including an amplifier and a speaker, a MIDI terminal 124 including a transmission driver and a reception photo coupler, a manipulator 125 including a scan wire and a driver thereof, and a display device 126. The serial flash memory 121 stores a control program executed by a CPU 101 of the tone generator LSI 100 and waveform sample data which the tone generator LSI 100 uses to generate a musical sound signal. The waveform sample data stored in the serial flash memory 121 may be compressed data or non-compressed data.

An internal configuration of the tone generator LSI 100 will be described. The central processing unit-(CPU) 101 is a processor that reads and executes a program stored in the serial flash memory 121, etc. to control overall operation of the electronic musical instrument or control overall operation of the tone generator LSI 100. Reference numerals 102 to 107 denote elements constituting a tone generating unit. During time division operation, the tone generating unit performs a musical sound generation process of a plurality of channels (ch). That is, the tone generating unit performs a musical sound generation process of each channel in each time slot obtained by dividing a so-called 1 DAC cycle (1 sampling cycle) by the number of channels.

A tone generating register 102 is a register including memory areas corresponding to the channels for setting various control parameters for controlling the musical sound generation process of each channel. The CPU 101 writes in the area of each channel of the tone generating register 102 a control parameter for controlling musical sound generation of the channel to control the musical sound generation process of each channel of the tone generating unit. For example, upon receiving a new musical sound pronunciation instruction (a note on event including data, such as pitch and intensity, of the musical sound), the CPU 101 assigns one of the channels of the tone generating unit for pronunciation thereof, sets a parameter including pitch and intensity of a musical sound to be generated to the area of the assigned channel of the tone generating register 102, and writes a pronunciation instruction for instructing commencement of pronunciation (tone generation) in the channel (a note on event process). As a result, the tone generating unit commences a musical sound generation process in the time slot allocated to the channel. Meanwhile, the pronunciation instruction may be received from another instrument via the MIDI terminal 124 or may be generated by the CPU 101 according to key manipulation of a keyboard included in the manipulator 125.

Operation of the respective units 102 to 107 of the tone generating unit in a time slot of the pronunciation-instructed channel when the pronunciation instruction is written in will be described. An address generation unit 103 generates a read address changing at a velocity corresponding to a designated pitch shift quantity every sampling cycle using the start address set in the tone generating register 102 as an initial value and outputs a request of a waveform sample to a serial flash I/F 108 using an integer part of the generated read address as a two words (2W) request waveform address. The serial flash I/F 108 performs a 2W access (FIG. 2(*b*), which will hereinafter be described) to the serial flash memory 121 according to the received waveform address (2W request) to sequentially read two waveform samples from a lead address SA which is the received waveform address. Thus, the serial flash I/F 108 functions as an access unit for performing a read access to the serial flash memory 121. An interpolation unit 104 interpolates between the read two waveform samples according to the decimal part of the read address to generate an interpolate sample. An envelope controller 105 generates a sound amplitude envelope indicating sound amplitude change from rise to decay or vice versa of a musical sound based on a sound envelope parameter set in the tone generating register 102 and controls amplitude of the interpolated sample input every sampling cycle based on the sound amplitude envelope. As a result, a musical sound waveform sample of the channel is generated. A mixing unit 106 mixes the generated musical sound waveform sample of the channel with a musical sound waveform sample generated by another channel. A DAC unit 107 converts the mixed digital samples into an analog waveform. The LPF 122 removes a noise component from the analog waveform. The sound system 123 outputs sound based on the analog waveform with the noise component removed.

Operation of the respective units 102 to 107 of the tone generating unit in a time slot of an attenuation-instructed channel when an attenuation instruction is written in will be described. Upon receiving an attenuation instruction of a musical sound being generated (a note off event including pitch of the musical sound to be attenuated), the CPU 101 searches a channel currently pronouncing with the pitch included in the attenuation instruction and, if the channel is found, writes an attenuation instruction for instructing commencement or acceleration of attenuation of the musical sound in the area of the channel of the tone generating register 102 (a note off event process). Consequently, the envelope controller 105 of the tone generating unit commences or accelerates attenuation of the sound amplitude envelope of the channel. As a result, attenuation of musical sound waveform sample of the channel is commenced or accelerated. A channel, the sound amplitude envelope of which is less than a predetermined value (inaudible), is in a pronunciation stoppage state. That is, the tone generating unit stops the musical sound generation process in the timing slot of the channel and a waveform address (2W request) is not output from the address generation unit 103. Consequently, the serial flash I/F 108 does not perform an access to the serial flash memory 121 for the channel. Read operation of the channel is stopped until the same channel is assigned for musical sound generation and commencement of pronunciation is instructed.

Even in various kinds of musical sound control other than note on and note off, the CPU 101 writes in an area of a channel generating a musical sound to be controlled of the tone generating register 102, a parameter for controlling the musical sound to control characteristics of the musical sound in the same manner.

The MIDI terminal 124 is a terminal for connection with an external MIDI instrument (not shown) complying with MIDI standards. A MIDI I/O 109 is an interface for inputting MIDI data input from the external MIDI instrument connected to the MIDI terminal 124 to the tone generator LSI 100 and outputting MIDI data generated by the tone generator LSI 100 to the external MIDI instrument connected to the MIDI terminal 124 under control of the CPU 101. The manipulator 125 includes a manipulator for setting values of various parameters disposed on a manipulation panel of the electronic musical instrument and a performance manipulator (a keyboard, etc.) for allowing a performer to input performance information. A manipulator I/O 110 is an interface for scanning a manipulation state of the manipulator 125 to input performance information based on an instruction from the CPU 101. The display device 126 is a display device for displaying various kinds of data according to an instruction from the CPU 101. A display I/O 111 is an interface for outputting data to be displayed to the display device 126. An internal ROM 112 is a nonvolatile read only memory for storing a program executed by the CPU at the time of starting, various kinds of a fixed number of data and conversion curves used to control the tone generating unit, etc. An internal RAM 113 is a volatile memory which the CPU 101 uses as a work area. The internal RAM 113 is used to store a program executed by the CPU, various kinds of parameters used to control the tone generating unit, etc. These memories 112 and 113 are normal parallel type memories for accessing a parallel bit address to read or write parallel bit data. Reference numeral 114 is a bus line for connection of these units. The bus line is a generic term for a control bus, a data bus, and an address bus.

The serial flash memory 121 will be described in detail. As described above, the serial flash memory 121 is a nonvolatile memory for storing 1 byte data in each address. Namely, 8 bits are stored as a unit in each address. Generally, the serial flash memory 121 stores a unit of m bits at each address. The serial flash memory 121 stores information including one or more programs each composed of a series of program instructions executed by the CPU 101 and one or more waveform data each composed of a series of waveform samples which the tone generating unit uses to generate musical sounds. A data length of each program instruction composed of program codes is one word (1W) or two words (2W). A data length of each waveform sample is two words (2W). A normal NOR type flash memory includes address terminals, the number of which corresponds to an address bit length, and data input and output terminals, the number of which corresponds to a data bit length. However, the serial flash memory 121 used in this embodiment is a kind of serial memory including a small number of terminals, wherein a small number of terminals are jointly used for addresses and data input and output such that address and data input and output are performed using serial data. The serial memory may be composed of not only a flash memory but also other memory such as EEPROM and SRAM. In this embodiment, a memory including 8 terminals is used as the serial flash memory 121. A serial flash memory including 6 terminals (pins) is shown in FIG. 1. CLK indicates a pin for inputting a clock signal, CS indicates a pin for inputting a chip select signal, and IO1 to IO4 indicate pins used for address and data input and output. The serial flash memory 121 includes a power supply pin VCC and a ground pin GND in addition to these 6 pins.

A chip select signal input to the pin CS is a signal for switching between valid state and invalid state of device manipulation. When the pin CS is "1" (when a predetermined high level voltage is applied to the pin CS), the serial flash memory 121 is in a non-selection state, i.e. a standby state in which read and write operations are not performed. Then data are read from the serial flash memory 121, when the pin CS becomes "0" (a predetermined low level voltage is applied to the pin CS) and a 8 bit instruction code, as serial data, is input to the pin IO1 using the next 8 clocks. Read instructions include Read Data (instruction code is 03h), Fast Read (instruction code is 0Bh), Fast Read Dual IO (instruction code is BBh), and Fast Read Quad IO (instruction code is EBh). Meanwhile, xxh indicates a hexadecimal notation.

In case of Read Data, when an initial address of 24 bits, as serial data, is input to the pin IO1 using 24 clocks after input of an instruction code 03h, 1 byte of the initial address, as serial data, is output from the pin IO2 in the next 8 clocks. After that, when the pin CS is "0," a read address is automatically incremented from the initial address although an address is not input. As a result, byte data of continuous addresses are output from the pin IO2 as serial data. When the pin CS becomes "1," output of data from the pin IO2 is stopped.

Meanwhile, a function in which a read address is automatically incremented to read continuous byte data while an address is not individually designated when the pin CS is "0" is referred to as Sequential Read. Any read instruction, which will hereinafter be described, may execute Sequential Read.

Fast Read is a read instruction operating in the same manner as Read Data. In case of Fast Read, however, 8 dummy clocks are inserted after input of an address and then data are output from the pin IO2. Fast Read may have a higher clock frequency than Read Data. Consequently, it is possible to read a series of data of continuous addresses at high speed.

In case of Fast Read Dual IO, an initial address of 24 bits is input using two pins after input of an instruction code BBh. Specifically, it is possible to input two bits in parallel in one clock using the pin IO1 and the pin IO02. Consequently, an initial address of 24 bits is input in 12 clocks after the instruction code and then a mode is input in the next 4 clocks. After input of the mode, the functions of the pin IO1 and the pin IO2 are switched from input to output, 1 byte of the initial address is output from the pin IO1 and the pin IO2 in the next 4 clocks, and Sequential Read is performed.

The mode will be described. Hexadecimal Axh (if 4 higher bits are Ah, 4 lower bits may have any values) or a value other than the above value (for the 4 higher bits, a value other than Ah) designates the mode. In a case in which Axh is input as a mode instruction, the mode becomes a Continuous Read Mode. Upon entry into this mode, the pin CS becomes "1" and data output is once interrupted. After that, when a read request is issued again, input of an instruction code Fast Read Dual IO may be omitted. That is, after the pin CS becomes "0" x, an address of 24 bits is input in 12 clocks using the pin IO1 and the pin IO2, and a mode of 8 bits is input in 4 clocks while input of an instruction code is omitted. Subsequently, Axh is input when the Continuous Read Mode is continued and a value other than Axh is input when the mode becomes off. Consequently, it is possible to read data of the address from the pin IO1 and the pin IO2 and subsequently data are read through Sequential Read. According to the Continuous Read Mode, an instruction code may be omitted, whereby it is possible to achieve high-speed random access.

Fast Read Quad IO is a read instruction (instruction code EBh) operating in the same manner as Fast Read Dual IO. In Fast Read Dual IO, address and mode input and data output are performed using the pin IO1 and the pin IO2. In Fast Read Quad IO, on the other hand, input and output thereof are performed using the four pins, i.e. the pin IO1 to the pin IO4. In addition, in Fast Read Dual IO, the functions of the pin IO1 and the pin IO2 are switched from input to output immediately after 4 clocks for mode input and then data output is commenced. In Fast Read Quad IO, on the other hand, 4 dummy clocks are inserted after 2 clocks for mode input, the functions of the pin IO1 to the pin IO04 are switched, and then data output is commenced. Subsequently, data are read through Sequential Read. Even in Fast Read Quad IO, the Continuous Read Mode may be designated. Meanwhile, in a case in which a Quad instruction of performing data input and output using the four pins, i.e. the pin IO1 to the pin IO04, is used, it is necessary to preset a status bit of Quad Enable (QE) mode in the serial flash memory 121 to on.

Figure 2A:
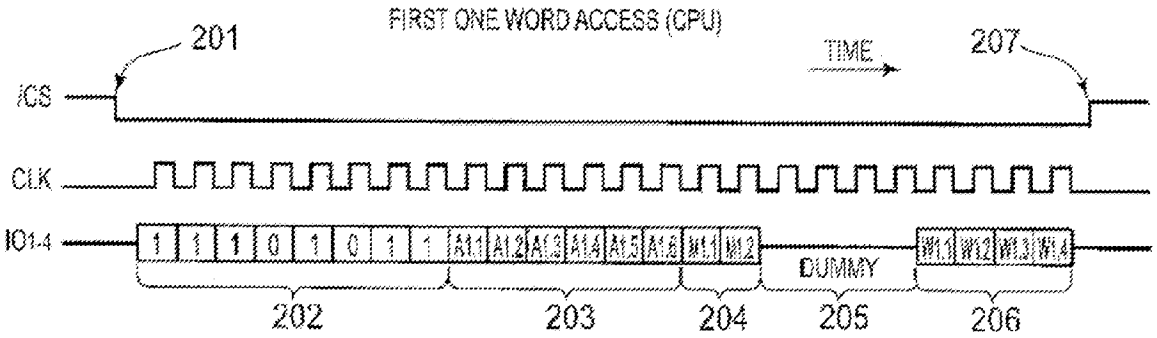
FIGS. 2(*a*) and 2(*b*) are a memory access timing diagram of a serial flash memory, and FIG. 2(*c*) is a memory access timing diagram of a parallel flash memory.
Figure 2B:
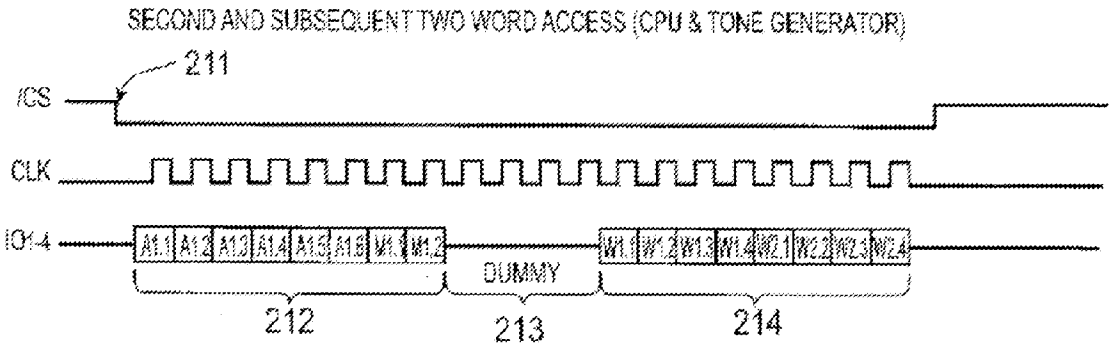
Figure 2C:
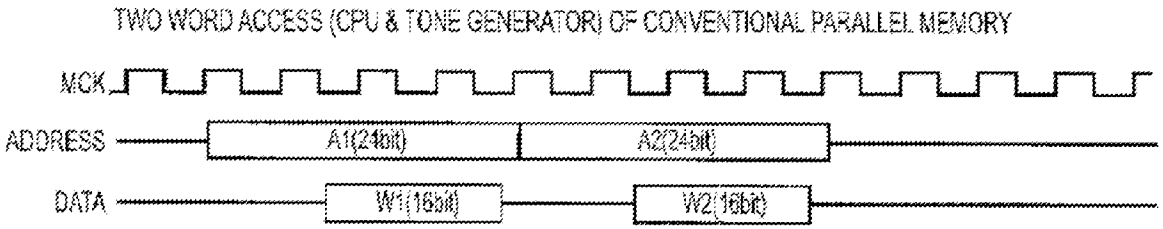

FIGS. 2(*a*) and 2(*b*) are a memory access timing diagram of the serial flash memory 121. The serial flash memory 121 stores 1 byte data in each address. That is, an address is designated to read data on a byte basis.

For comparison, a two word access timing diagram of a conventional NOR type flash memory (SRAM type) is shown in FIG. 2(*c*). This flash memory includes 24 address terminals and 16 data terminals. A parallel address of 24 bits is input to the respective address terminals and one word (16 bits) stored in the address is output as parallel data from the data terminals. 'MCK' indicates a clock signal. In this case, the clock signal has a frequency of slightly more than 33 MHz. 'Address' indicates timing for inputting an address of 24 bits and 'Data' indicates timing for outputting data from the address.

FIG. 2(*a*) is a first one word access timing diagram of the serial flash memory 121 according to this embodiment and FIG. 2(*b*) is a second and subsequent two word access timing diagram of the serial flash memory 121 according to this embodiment. Hereinafter, a case in which a Continuous Read Mode is designated using a Fast Read Quad IO instruction will be described by way of example.

'CLK' of FIG. 2(*a*) and FIG. 2(*b*) indicates a clock signal. The clock signal MCK of the conventional example shown in FIG. 2(*c*) has a frequency of slightly more than 33 MHz, whereas the clock signal CLK of the tone generator LSI according to this embodiment has a frequency of slightly more than 66 MHz, which is twice that of the clock signal MCK of the conventional example. FIGS. 2(*a*) to 2(*c*) are shown on almost the same time scale.

In the first access operation shown in FIG. 2(*a*), CS becomes "0" at time 201 and code EBh (Fast Read Quad IO instruction code) is input to the pin IO1 during a period 202 of the next 8 clocks, an address of 24 bits is input using the four pins, i.e. the pin IO1 to the pin IO4, during a period 203 of the next 6 clocks, and a mode of 8 bits is input using the four pins, i.e. the pin IO1 to the pin IO4, during a period 204 of the next 2 clocks. As the mode, Axh designating the Continuous Read Mode is input. After a dummy period 205, 1 byte data of the address and 1 byte of the next address (a total of 16 bits) are read using the four pins, i.e. the pin IO1 to the pin IO4, during a period 206 of the next 4 clocks. CS becomes "1" at time 207 and the first one word access is ended. Of course, it is possible to sequentially read data using the Sequential Read in a state in which CS is "0."

Once the Continuous Read Mode is designated by the first access, input of an instruction code may be omitted in a second and subsequent access using a Fast Read Quad IO instruction, which follows the Continuous Read Mode. In FIG. 2(*b*), therefore, input of an instruction code is omitted after CS becomes "0" at time 211 and an address of 24 bits and a mode of 8 bits are directly input during a period 212 of 8 clocks. After a dummy period 213, successive two words (16 bits×2) are read from the consecutive addresses starting from a leading address during a period 214 of 8 clocks.

As can be seen from FIG. 2(*b*), the Continuous Read Mode is used with the result that it is possible to read two words in slightly more than 20 clocks (a margin of one to several clocks). Even in the conventional parallel memory access of FIG. 2(*c*) having almost the same time scale, two words are read within almost the same time. That is, it is possible to secure the same access speed as the conventional parallel memory using the serial flash memory. In a case in which the parallel memory is used, the length of a wire may be increased, which may increase the amount of an electromagnetic wave (including noise) emitted from the wire. In a case in which the serial flash memory according to this embodiment is used, on the other hand, the number of pins of the chip is decreased with the result that it is possible to decrease the length of a wire and thus to reduce an emission amount of an unnecessary electromagnetic wave.

Figure 3:
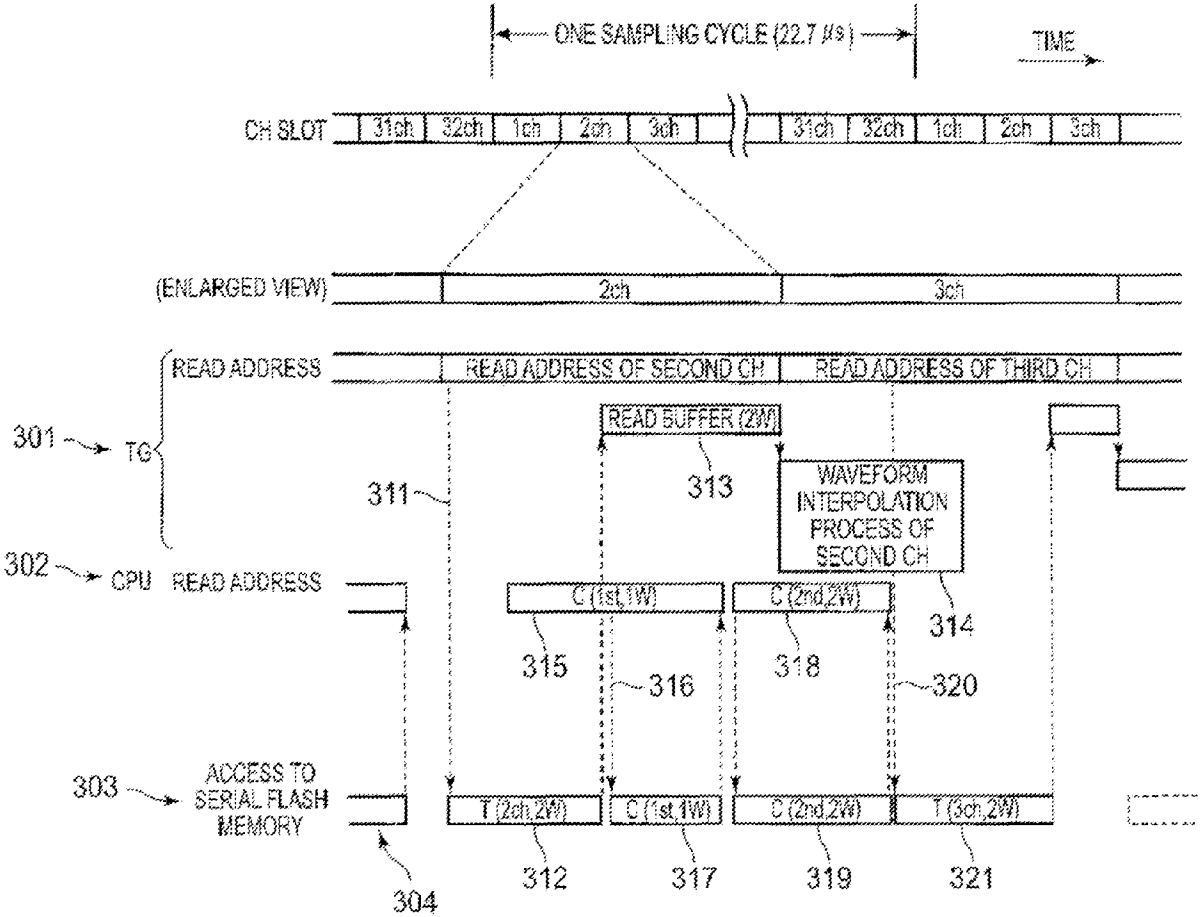
FIG. 3 is an access timing diagram of a CPU and the serial flash memory.

FIG. 3 is an access timing diagram of the serial flash memory 121 from the CPU 101 and the tone generating unit (the address generation unit 103). Reference numeral 301 indicates an example of access timing at which the address generation unit 103 of the tone generating unit (TG) outputs a read address of a waveform (a waveform address) to issue a waveform sample request (2W request) to the serial flash I/F 108, and the tone generating unit receives two waveform samples (two words) from the waveform address output from the serial flash I/F 108 in response to the waveform sample request. Reference numeral 302 indicates an example of access timing in which the CPU 101 outputs a read address (instruction address) indicated by a program counter to issue a fetch request (1W code request or 2W code request) to the serial flash I/F 108, and the CPU 101 fetches a program instruction (one word or two words) which is read from the serial flash I/F 108 from a lead address CA which is the read address in response to the fetch request. Reference numeral 303 indicates a period (1W or 2W access period) during which the serial flash I/F 108 receives the waveform sample request or the fetch request and accesses the serial flash memory 121 to read one word data or two word data.

Prior to operation shown in FIG. 3, the first access using the Fast Read Quad IO instruction of FIG. 2(*a*) is performed with respect to the serial flash memory 121 and the Continuous Read Mode is designated. In this case, therefore, a Fast Read Quad IO access to the serial flash memory 121 is entirely performed in the Continuous Read Mode of FIG. 2(*b*). In addition, in FIG. 3, musical sounds are being generated in a second channel and a third channel of the tone generating unit, and the address generation unit 103 outputs a waveform address of a 2W request to the serial flash I/F 108 in timing slots allocated to the second channel and the third channel (waveform sample request). The reason that the waveform sample request is a 2W request is that successive two waveform samples are supplied for interpolation between samples performed by the interpolation unit 104. The serial flash I/F 108, receiving the waveform address (2W request), performs a 2W access (FIG. 2(*b*)) to the serial flash memory 121 in the time slot of the same channel, and reads two words (two waveform samples) from a lead address which is the waveform address and supplies the read two words to the interpolation unit 104. Meanwhile, the serial flash I/F 108 does not access the serial flash memory 121 in a time slot of a channel which is not pronounced.

On the other hand, the CPU 101 reads an operating program from the serial flash memory 121 and executes the operating program. The operating program includes a one word program instruction and a two word program instruction. According to output of a 1W request specifying an instruction code address from the CPU 101 (fetch request), the serial flash I/F 108 performs a 1W access (4 clock shorter than the example of FIG. 2(*b*)) to the serial flash memory 121, and reads one word (one program instruction) from a lead address which is the instruction address and supplies the read one word to the CPU 101. In addition, according to output of a 2W request specifying an instruction code address from the CPU 101 (fetch request), the serial flash I/F 108 performs a 2W access (FIG. 2(*b*)) to the serial flash memory 121, and reads two words (one program instruction) from a top or leading address that is the instruction address and supplies the read two words to the CPU 101.

Arrow 311 indicates a time when the waveform address (2W request) of the second channel outputted from the address generation unit 103 of the tone generating unit in the time slot of the second channel is received by the serial flash I/F 108. In this case, an access from the CPU 101 to the serial flash memory 121 is not performed. Consequently, the output 2W request is directly received by the serial flash I/F 108 at a time when the time slot is commenced. The serial flash I/F 108 performs a 2W access 312 to the serial flash memory 121 during a period 312 of slightly more than 20 clocks from a time 311 to read two words (two waveform samples) from a lead address which is the waveform address. The read two waveform samples are temporarily stored in a read buffer (not shown) of the interpolation unit 104 at a time when the 2W access 312 is completed. The interpolation unit 104 is operated in delayed manner at a time slot ((i−1)-th channel) one channel later than a time slot (i-th channel) of the address generation unit 103, and an inter-sample interpolation process for generating an interpolated sample of the (i−1)-th channel (in FIG. 3, an interpolated sample of the second channel) using the two waveform samples stored in the read buffer is performed during a predetermined period (for example, a period 314 of FIG. 3) from the top of each time slot ((i−1)-th channel). For this reason, it is necessary for the two waveform samples used in the interpolation process of each time slot to be prepared in the read buffer until the interpolation process is commenced.

On the other hand, the CPU 101 performs a read request (fetch request) of each program instruction of the operating program independently of the tone generating unit. A period 315 is a period during which the CPU 101 outputs an instruction address (1W request), which is a read address, to the serial flash I/F 108. At a time (the front of the period 315) when the CPU 101 starts to output the 1W request, an access 312 of the sound generating unit to the serial flash memory 121 is performed and an access according to the 1W request is put on hold until the access is ended. At a time 316 after the access 312 is ended, the 1W request of CPU 101 is received by the serial flash I/F 108. The serial flash I/F 108 performs a 1W access 317 to the serial flash memory 121 during a period 317 of slightly more than the next 16 clocks, and reads a one word program instruction of a one word length from a lead address which is the instruction address. At a time when the read is completed (at the end of the period 317), the read program instruction is supplied from the serial flash I/F 108 to the CPU 101 and the CPU 101 fetches the read program instruction. The CPU 101 decodes and performs the fetched program instruction according to a control sequence in the apparatus.

Subsequently to the 1W request, the CPU 101 outputs the next instruction address (2W request). At this time (at the front of a period 318), an access to the serial flash memory 121 for the sound generation unit is not performed. Consequently, the 2W request is instantly received by the serial flash I/F 108 and a corresponding 2W access 319 to the serial flash memory 121 is performed during a period 319 of slightly more than the next 20 clocks. At the end of the period 319, the serial flash I/F 108 supplies a one program instruction of a two word length read through the 2W access 319 to the CPU 101 and the CPU 101 fetches the read program instruction.

Furthermore, at a time when the time slot of the third channel is commenced, the address generation unit 103 of the tone generating unit outputs a waveform address of 2W request for the third channel to the serial flash I/F 108. However, the 2W access 319 of the CPU 101 to the serial flash memory 121 is still being performed and the 2W request of the third channel is put on hold until the access 319 is ended. At a time 320 after the period 319 is ended, the serial flash I/F 108 receives the 2W request of the third channel and performs a 2W access 321 of slightly more than 20 clocks. As a result, two waveform samples (two words) used in an interpolation process of the third channel are read from the serial flash memory 121 and are then stored in the read buffer.

Conflict between an access to the serial flash memory 121 performed by the tone generating unit and an access to the serial flash memory 121 performed by the CPU 101 is adjusted by the serial flash I/F 108. In particular, a 2W access according to a 2W request from the tone generating unit has a deadline until the interpolation process of the interpolation unit 104 is commenced. For this reason, the 2W access is performed prior to an access according to a 1W request or a 2W request from the CPU 101. That is, in a case in which the 2W request from the tone generating unit and the 1W request or the 2W request from the CPU 101 are output together at a time when a new access to the serial flash memory 121 is performed, the serial flash I/F 108 performs the 2W access according to the 2W request from the tone generating unit. However, even when the 2W request from the tone generating unit is output during the access to the serial flash memory 121 for the CPU 101, as described with reference with FIG. 3, the 2W access according to the 2W request is not executed by interruption. In addition, a time slot of one channel has a sufficient length such that, even when the serial flash I/F 108 commences the longest access of the CPU 101 (in this case, 2W access) at a time when a time slot of any channel of the address generation unit 104 is commenced, an access of a predetermined bit length for the channel (in this case, 2W access) can be completed in the same time slot. Namely, each time slot has a sufficient time length during which the longest access and the access of the predetermined length are just performed (in this case, a time length during which a margin of about 1 to 10 clocks is added to 2W access×two times).

FIG. 4(*a*) is a flowchart showing operation of a starting program executed by the CPU 101 at the time of power on or reset of the electronic musical instrument according to this embodiment. The starting program is stored in the internal ROM 112 and the CPU 101 executes the starting program at the time of power on or reset. The CPU 101 resets a state of the serial flash memory 121 (stored data are not changed) at step 401. At step 402, the CPU 101 reads a program for initializing a mode from the serial flash memory 121 using the serial flash I/F 108 and loads the program in the internal RAM 113 and jumps an instruction address indicated by the program counter (an address of a program instruction executed by the CPU 101) to a start point of the loaded initialization program (an address of a program instruction to be initially executed). As a result, the CPU 101 sequentially reads program instructions of the initialization program from the internal RAM 113 one by one. Meanwhile, at step 402, a read instruction that can be executed even when any mode is not set (for example, Read Data of instruction code 03h) is used in a read access to the serial flash memory 121.

FIG. 4(*b*) is a flowchart showing a processing sequence of an initialization program which is loaded in the internal RAM 113 and executed by CPU 101. At step 411, the CPU 101 reads information, such as manufacturer name, memory type, and capacity, and status bits (a plurality of bits) indicating various kinds of current status from the register of the serial flash memory 121 using the serial flash I/F 108 to specify a mode (QE mode) validating a Fast Read Quad IO instruction. The QE mode specified in this case may vary depending upon manufacturers and memory types. At step 412, it is determined whether a status bit of the QE mode is '1,' i.e. the serial flash memory 121 is already set to the QE mode. In a case in which the serial flash memory 121 is not set to the QE mode, at step 413, the CPU 101 initially sets the serial flash memory 121 to the QE mode using the serial flash I/F 108. At step 414, the serial flash I/F 108 is driven to perform a first word access (FIG. 2(*a*)) to the serial flash memory 121 using a Fast Read Quad IO instruction (EBh). This read access may be a dummy access and the read data may be or may not be actually used. In addition, the read access designates the Continuous Read Mode (Axh) as the mode and subsequent data read from the serial flash memory 121 performed by the serial flash I/F 108 is entirely a read access performed by a Fast Read Quad IO instruction, although an instruction code (EBh) described with reference to FIG. 2(*b*) is omitted from each read address.

Subsequently, the CPU 101 jumps an instruction address indicated by the program counter to a start point of a control program stored in the serial flash memory 121. As a result, the CPU 101 sequentially reads program instructions of the control program stored in the serial flash memory 121 one by one. More specifically, whenever the instruction address indicated by the program counter is changed, the CPU 101 outputs an instruction address for requesting a one word or two word program instruction of the address to the serial flash I/F 108 (fetch request). The serial flash I/F 108 performs a Fast Read Quad IO access (FIG. 2(*b*)), from which an instruction code (EBh) is omitted, to the serial flash memory 121 according to the instruction address (1W request or 2W request) to read one program instruction of one word or two words from the serial flash memory 121. The read one program instruction is fetched by the CPU 101.

FIG. 4(*c*) is a flowchart showing a processing sequence of a control program executed by the CPU 101 after the initialization program of FIG. 4(*b*) is executed. First, at step 421, initial setting is performed. At step 422, generation of various events, such as manipulation of the manipulator 125, data reception through the MIDI I/O 124, notification of a state from the tone generator, and time interruption performed by a timer (not shown), is detected. When an event is present at step 423, a process according to the event is performed at step 424. Subsequently, the procedure returns to step 422 and the event detection process and the subsequent process are repeated. A concrete example of the processes performed in this case includes a tone edit process for adjusting a tone according to the manipulation of the manipulator and an automatic performance or automatic accompaniment process according to the timer interruption in addition to a note off event process according to a note off event.

Meanwhile, although, in the above embodiment, the initial dummy read for the serial flash I/F 108 setting the serial flash memory 121 to the Continuous Read Mode after power on is performed according to the instruction of the CPU 101, the initial dummy read may be performed according to the instruction from the tone generating unit. In addition, in the above embodiment, a four IO read instruction performed in the QE mode (A four pin bi-directional high-speed read instruction for performing address input and data output by 4 bits (in one clock) using four pins of the serial flash memory as in the above Fast Read Quad IO instruction) is referred to as a four IO read instruction. In the same manner, an n pin bi-directional high-speed read instruction for performing address input and data output by n bits using n pins is referred to as an n IO read instruction. Alternatively, a two IO read instruction may be used. In addition, when a six IO read instruction or an eight IO read instruction is provided in the serial flash memory 121 in future, the six IO read instruction or the eight IO read instruction may be used instead of the four IO read instruction.

Although, in the above embodiment, one program instruction of the program read from the serial flash memory 121 and executed by the CPU 101 is a 1W instruction or a 2W instruction, the length of one program instruction is arbitrary. In addition, the CPU 101 may read and simultaneously store a plurality of program instructions from the serial flash memory 121 through one read access and then sequentially execute the program instructions. For example, in the above embodiment, in a case in which a program instruction to be next read is a 1W instruction, a 1W request is issued from the CPU 101 to the serial flash memory 121 to fetch a 1W program instruction. On the other hand, in a case in which a program instruction to be next read is a 2W instruction, a 2W request is issued to the serial flash memory 121 to fetch a 2W program instruction. However, even in a case in which a program instruction to be next and subsequently read is a 1W instruction, a 2W request may be issued from the CPU 101 to the serial flash memory 121 to fetch two 1W program instructions and to sequentially execute the fetched 1W program instructions.

In some CPUs, a plurality of word program instructions is read through one fetch, the instruction buffer of the CPU is replenished with the read program instructions, and the instructions are sequentially decoded and executed. In a case in which a CPU having the above functions is used as the CPU 101, therefore, it is possible to read a plurality of word program instructions from the serial flash memory 121 through one read access and to sequentially decode and execute the program instructions. In this case, a program code read from the serial flash memory 121 is replenished according to vacancy of the instruction buffer or execution scheduling in the CPU. Consequently, the program code may not be read on a unit instruction basis. The program code to be read is stored in an address according to the progress of the program counter. However, such read is not limited to read from the address indicated by the program counter. Read may be commenced in the middle of one instruction including a plurality of words or may be ended in the middle of one instruction through one read. Consequently, a read request of the program code from the CPU 101 to the serial flash memory 121 is a variable length having a 1W or a 2W but is not limited to an instruction unit.

In addition, although in the above embodiment, the CPU 101 issues a fetch request and fetches the program instruction during the period 315 or 318 of FIG. 3, the 'decoding' or 'execution' of the corresponding instruction fetched in the CPU 101 is not limited to that the program instruction is executed in the same time slot as the fetched instruction. In some CPUs, pipeline processing is performed. Consequently, decoding may be performed after predetermined clocks from the fetch timing. Processing, such as decoding or execution, after fetching may be performed according to an internal control sequence of the CPU.

In addition, the program stored in the serial flash memory 121 may include a code indicating a constant number data in addition to a code indicating the instructions. For example, a constant number data for reading may be stored in the serial flash memory 121 as a part of the program and a processor may execute an instruction for loading the data. In this case, the processor fetches and decodes the instruction, reads data from the serial flash memory 121 according to decoding result, and stores the read data in the register. Even in a case in which a program code indicating such a constant number data is read, a read request is issued from the CPU 101 to the serial flash memory 121 and the program code may be read. In addition, the size of the data read at one time may be 1W or 2W depending upon an execution situation.

Although, in the above embodiment, the serial flash memory is used as a memory device for storing a waveform sample and a control program, a memory that is capable of reading data in parallel in which pins corresponding to the bit number of an address and data are provided (but a memory having a function of Sequential Read or Continuous Read Mode) may be used instead of the serial flash memory. In this case, the wire on the board is not be configured to have a compact structure. However, a memory access time is reduced due to the function of Sequential Read or Continuous Read Mode. Consequently, it is possible to increase the number of simultaneous pronunciations of the tone generating unit.

What is claimed is:

1. A sound generation apparatus comprising:

a serial memory that stores information in units of m bits per address, the stored information including waveform data representing a plurality of waveform samples, the serial memory being capable of performing different input/output operations including n-bit input/output operation for serially inputting and outputting n bits per clock using n pins (m and n being integers equal to or greater than 2 and m>n);

an access unit that performs a read access to the serial memory for reading therefrom the waveform data; and a tone generating unit that has a plurality of channels operating in time-divisional manner to generate therethrough sound signals based on waveform samples read from the serial memory, each channel issuing a sample request for a waveform sample to the access unit with specifying a read address of the waveform sample, wherein upon power on or reset of the sound generation apparatus, the access unit sets the serial memory to enable the n-bit input/output operation, and in response to the sample request from each channel of the tone generating unit, the access unit uses an n-bit input/output instruction to read the waveform sample by n bits per clock from a lead address that is the read address specified by the sample request, and supplies the waveform sample read from the serial memory to the tone generating unit.

2. The sound generation apparatus according to claim 1, wherein according to one read access performed by the access unit in response to the sample request, the serial memory outputs a sequence of units each composed of m bits, from the lead address that is the read address specified by the sample request and from subsequent addresses immediately following the lead address, and the access unit performs one read access to the serial memory using the n-bit input/output instruction in response to the sample request issued from each channel of the tone generating unit so as to read a plurality of waveform samples in the form of a sequence of units of m bits from the lead address and subsequent addresses, and supplies the read waveform samples to the tone generating unit.

3. The sound generation apparatus according to claim 1, wherein the serial memory can be set to a continuous read mode, in which the serial memory receives an input/output instruction and a read address from the access unit in response to a first read access performed by the access unit and outputs information according to the received input/output instruction from the lead address that is the received read address, and in which the serial memory receives another read address without the input/output instruction from the access unit in response to a second read access performed by the access unit and outputs information according to the same input/output instruction as that received in the first read access from the lead address that is the read address received in the second read access, and wherein the access unit performs an initial read access upon power on or reset of the sound generation apparatus for setting the serial memory to the continuous read mode, then the access unit performs a subsequent read access including a read address and excluding an input/output instruction in response to a sample request issued from each channel of the tone generating unit for reading a waveform sample from the read address included in the subsequent read access and supplies the read waveform sample to the tone generating unit.

4. A sound generation apparatus comprising:

a serial memory that stores information in units of m bits per address, the stored information including waveform data representing a plurality of waveform samples and a control program composed of a plurality of program codes, the serial memory being capable of performing different input/output operations including n-bit input/output operation for serially inputting and outputting n bits per clock using n pins (m and n being integers equal to or greater than 2 and m>n);

an access unit that performs a read access to the serial memory for reading therefrom the waveform data and the control program;

a tone generating unit that has a plurality of channels operating in time-divisional manner to generate therethrough sound signals based on waveform samples read from the serial memory, each channel issuing a sample request for a waveform sample to the access unit with specifying a read address of the waveform sample; and a processor that issues a code request for a program code to the access unit with specifying a read address of the program code and that fetches the program code supplied from the access unit in response to the code request to thereby execute the control program and thus to control the tone generating unit, wherein upon power on or reset of the sound generation apparatus, the access unit sets the serial memory to enable the n-bit input/output operation, in response to the sample request from each channel of the tone generating unit, the access unit uses an n-bit input/output instruction to read the waveform sample by n bits per clock from a lead address that is the read address specified by the sample request, and supplies the waveform sample read from the serial memory to the tone generating unit, and in response to the code request from the processor, the access unit uses an n-bit input/output instruction to read the program code by n bits per clock from a lead address that is the read address specified by the code request from the processor and supplies the program code read from the serial memory to the processor.

5. The sound generation apparatus according to claim 4, wherein according to one read access performed by the access unit in response to the sample request or code request, the serial memory outputs a sequence of units each composed of m bits, from the lead address that is the read address specified by the sample request or code request and from subsequent addresses immediately following the lead address, and the access unit performs one read access to the serial memory using the n-bit input/output instruction in response to the sample request issued from each channel of the tone generating unit so as to read a plurality of waveform samples in the form of a sequence of units of m bits from the lead address and subsequent addresses, and supplies the read waveform samples to the tone generating unit.

6. The sound generation apparatus according to claim 4, wherein the serial memory can be set to a continuous read mode, in which the serial memory receives an input/output instruction and a read address from the access unit in response to a first read access performed by the access unit and outputs information according to the received input/output instruction from the lead address that is the received read address, and in which the serial memory receives another read address without the input/output instruction from the access unit in response to a second read access performed by the access unit and outputs information according to the same input/output instruction as that received in the first read access from the lead address that is the read address received in the second read access, and wherein the access unit performs an initial read access upon power on or reset of the sound generation apparatus for setting the serial memory to the continuous read mode, then the access unit performs a subsequent read access including a read address and excluding an input/output instruction in response to a sample request issued from each channel of the tone generating unit for reading a waveform sample from the read address included in the subsequent read access and supplies the read waveform sample to the tone generating unit, and also the access unit performs a subsequent read access including a reading address and excluding an input/output instruction in response to a code request issued from the processor for reading a program code from the read address included in the subsequent read access and supplies the read program code to the processor.

7. The sound generation apparatus according to claim 4, wherein a time slot allocated in time-divisional manner to each channel of the tone generating unit has a time length sufficient such that in response to a sample request issued from a channel of the tone generating unit subsequently from a code request issued from the processor, the access unit completes reading of the waveform sample within the time slot allocated to the channel after reading of the program code is completed in response to the code request issued from the processor in the same time slot.

8. A sound generation apparatus comprising:

a serial memory that stores information in units of m bits per address, the stored information including waveform data representing a plurality of waveform samples, the serial memory being capable of performing n-bit input/output operation in response to an n-bit input/output instruction for serially inputting and outputting n bits per clock using n pins (m and n being integers equal to or greater than 2 and m>n);

an access unit that performs a read access to the serial memory for reading therefrom the waveform data; and a tone generating unit that has a plurality of channels operating in time-divisional manner to generate therethrough sound signals based on waveform samples read from the serial memory, each channel issuing a sample request for a waveform sample to the access unit with specifying a read address of the waveform sample, wherein in response to the sample request from each channel of the tone generating unit, the access unit uses the n-bit input/output instruction to read the waveform sample by n bits per clock from a lead address that is the read address specified by the sample request, and supplies the waveform sample read from the serial memory to the tone generating unit.

9. A sound generation method of generating sound signals using a serial memory and a tone generator, the serial memory storing information in units of m bits per address, the stored information including waveform data representing a plurality of waveform samples, the serial memory being capable of performing different input/output operations including n-bit input/output operation for serially inputting and outputting n bits per clock using n pins (m and n being integers equal to or greater than 2 and m>n), the tone generator having a plurality of channels operating in time-divisional manner to generate therethrough the sound signals based on the waveform samples read from the serial memory, the sound generation method comprising:

upon power on or reset of the tone generator, setting the serial memory to enable the n-bit input/output operation;

issuing a sample request from each channel of the tone generator for a waveform sample with specifying a read address of the waveform sample;

performing a read access to the serial memory in response to the sample request issued from each channel of the tone generator such that an n-bit input/output instruction is used to read the waveform sample by n bits per clock from a lead address that is the read address specified by the sample request; and supplying the waveform sample read from the serial memory to the tone generator.

* * * * *